US012454399B2

(12) United States Patent
Hagedorn et al.

(10) Patent No.: US 12,454,399 B2
(45) Date of Patent: Oct. 28, 2025

(54) PAPER-BASED PACKAGE CUSHIONING FOR A PACKAGING ASSEMBLY

(71) Applicant: Haier US Appliance Solutions, Inc., Wilmington, DE (US)

(72) Inventors: Alexander Hagedorn, Louisville, KY (US); Pankaj Vishram Jadhav, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 18/430,810

(22) Filed: Feb. 2, 2024

(65) Prior Publication Data

US 2025/0250090 A1 Aug. 7, 2025

(51) Int. Cl.

*B65D 81/107* (2006.01)
*B65D 81/127* (2006.01)
*B65D 85/68* (2006.01)

(52) U.S. Cl.

CPC ..... *B65D 81/107* (2013.01); *B65D 81/127* (2013.01); *B65D 85/68* (2013.01); *B65D 2581/053* (2013.01); *B65D 2585/6815* (2013.01); *B65D 2585/6845* (2013.01)

(58) Field of Classification Search

CPC ..... B65D 81/02; B65D 81/022; B65D 81/05; B65D 81/055; B65D 81/107; B65D 81/127; B65D 85/68; B65D 2581/053; B65D 2585/6815; B65D 2585/6845

USPC ..... 206/320, 521, 583–594

See application file for complete search history.

(56) References Cited

U.S. PATENT DOCUMENTS

| | | | | |
|---|---|---|---|---|
| 3,023,885 A * | 3/1962 | Kindseth | B65D 81/133 206/594 |
| 5,259,508 A * | 11/1993 | Beckerman | B65D 81/133 206/587 |
| 5,772,037 A * | 6/1998 | Hurley | B65D 81/054 206/586 |
| 6,471,067 B1 * | 10/2002 | Lancaster | B65D 81/1275 206/523 |
| 11,738,930 B2 * | 8/2023 | Wang | B65D 81/107 206/522 |
| 12,246,526 B2 * | 3/2025 | Hermanson | B65D 81/107 |
| 12,269,669 B2 * | 4/2025 | Wang | B65D 81/127 |

FOREIGN PATENT DOCUMENTS

| | | |
|---|---|---|
| CN | 1205966 A | 1/1999 |
| CN | 2647757 Y | 10/2004 |
| CN | 203211644 U | 9/2013 |

(Continued)

OTHER PUBLICATIONS

CN 103072762, Hou L, May 2013 (Year: 2013).*

(Continued)

*Primary Examiner* — Bryon P Gehman
(74) *Attorney, Agent, or Firm* — Dority & Manning, P.A.

(57) ABSTRACT

A packaging assembly for a domestic appliance may include a corrugated frame defining an enclosed section. The packaging assembly may further include a paper-based package cushion fully enclosed within the enclosed section of the corrugated frame. The paper-based package cushion may include a molded paper composite. The molded paper composite being a wet molded paper composite formed via a wet molding process.

18 Claims, 4 Drawing Sheets

(56) References Cited

FOREIGN PATENT DOCUMENTS

| | | | | |
|---|---|---|---|---|
| CN | 105416854 | B | | 5/2018 |
| CN | 114408381 | A | | 4/2022 |
| JP | 2001162701 | A | * | 6/2001 |
| JP | 5341740 | B2 | | 11/2013 |

OTHER PUBLICATIONS

"Paper Log Maker; Step-by-Step Guide", easyprepper101, accessed https://www.youtube.com/watch?v=UXd6xabm4D0 on Feb. 1, 2024, 3 pages.
"Paper waste briquetting and recycling", Weima, accessed https://weima.com/en/briquetting/paper-briquettes/ on Feb. 1, 2024, 8 pages.
"Protective Packaging Buffers", Smurfit Kappa Group, accessed https://www.smurfitkappa.com/innovation/success-stories/rheem on Feb. 1, 2024, 25 pages.
"How to Make Quick and Easy Newspaper Bricks for Your Fire", LongTimeMother, Apr. 22, 2023, accessed https://dengarden.com/home-improvement/How-I-make-quick-and-easy-Newspaper-Bricks-for-burning-in-my fire, on Feb. 1, 2024, 26 pages.

* cited by examiner

PAPER-BASED PACKAGE CUSHIONING FOR A PACKAGING ASSEMBLY

FIELD OF THE DISCLOSURE

The present subject matter relates generally to a packaging assembly, and more particularly to a packaging assembly for a domestic appliance.

BACKGROUND OF THE DISCLOSURE

Domestic appliances (e.g., dishwashing appliances, refrigerator appliances, oven appliances, etc.) are available in a variety of configurations. Often in order to ship domestic appliances, robust packaging assemblies are required. These packaging assemblies may be configured to protect the domestic appliances during shipping and handling of the domestic appliance. For instance, the packaging assemblies typically include some sort of cushioning to help absorb shock (e.g., from drops or impacts) that may be experienced during shipping and handling.

Commonly, expanded polystyrene (EPS) may be utilized as cushioning for packaging assemblies of domestic appliances. However, challenges exist with the use of EPS as a cushioning. For example, while EPS is recyclable, it is typically only recyclable at specific drop off sites. This can cause inconveniences for a user as EPS often cannot be recycled through household recycling streams. Furthermore, EPS is often glued to a frame (e.g., a cardboard frame) of the packaging assembly. In such cases, even if the packaging assembly is brought to a drop off site, the packaging assembly can still end up in a landfill where they are not recycled as the EPS may be difficult and time consuming to separate from the frame. Additionally, EPS has a propensity to crumble or break apart during shipping. As the EPS is often not enclosed within the frame, the loose pieces may cause a mess when a user unpacks their domestic appliance.

Accordingly, a packaging assembly for a domestic appliance that obviates one or more of the above-mentioned drawbacks would be useful.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a packaging assembly is provided. The packing assembly may include a corrugated package frame. The corrugated frame may include a first panel and a second panel. The packing assembly may further include a paper-based package cushion enclosed within the first panel and the second panel of the corrugated package frame. The paper-based package cushion may include a molded paper composite.

In another exemplary aspect of the present disclosure, a packaging assembly for a domestic appliance is provided. The packing assembly may include a corrugated frame defining an enclosed section. The packing assembly may further include a paper-based package cushion fully enclosed within the enclosed section of the corrugated frame. The paper-based package cushion may further include a molded paper composite. The molded paper composite being a wet molded paper composite formed via a wet molding process.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
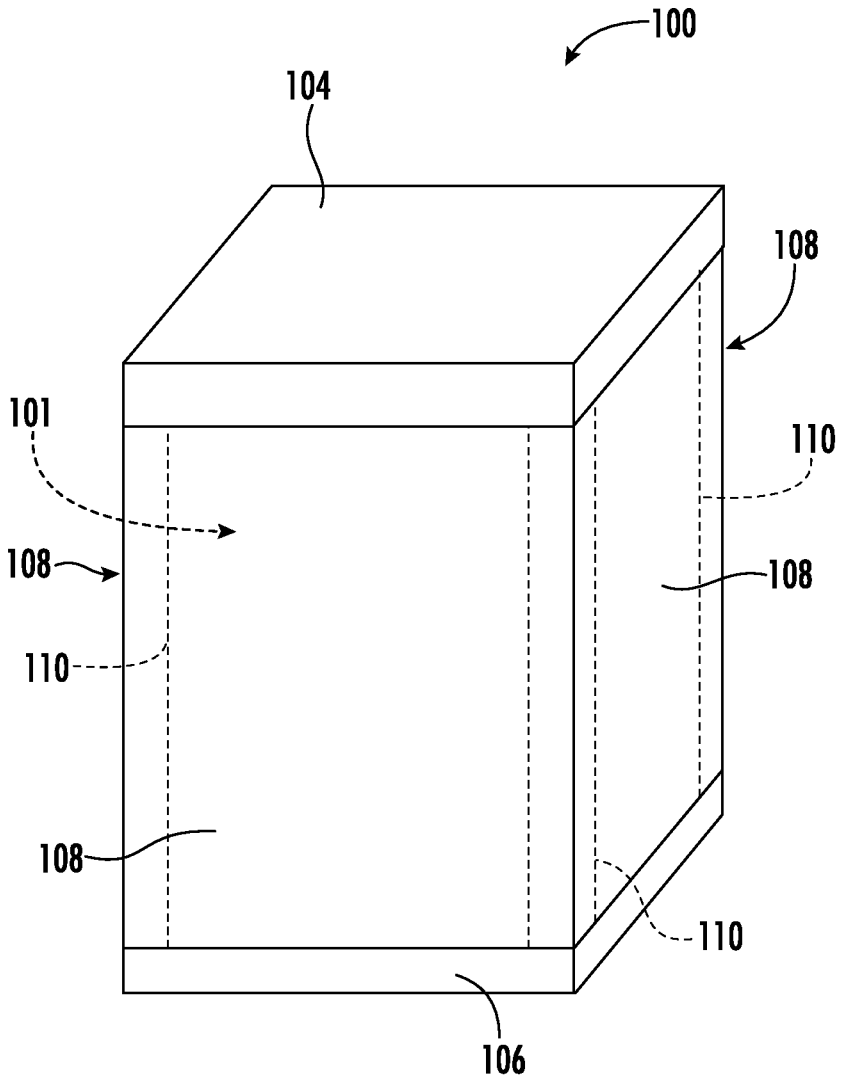
FIG. 1 provides a perspective view of a packaging according to one or more exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). The term "at least one of" in the context of, e.g., "at least one of A, B, and C" refers to only A, only B, only C, or any combination of A, B, and C. In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations.

According to one or more exemplary embodiments of the present subject matter, a packaging assembly for a domestic appliance is provided. The exemplary packaging assembly may advantageously include a paper-based package cushion for absorbing impacts or shocks during shipping and handling of the domestic appliance. As will be appreciated, the paper-based package cushion may advantageously be molded from wastepaper, such as shredded paper. A wet molding process may be advantageously utilized to mold the paper-based package cushion into desired shapes are sizes. Moreover, once molded the paper-based package cushion may advantageously be enclosed within a corrugated package frame. The corrugated package frame may also be a paper-based (e.g., may be constructed from a paper material such as cardboard). In this regard, when the packaging assembly has made it to its final location, the combination the packaging assembly in its entirety may be recycled.

Figure 2:
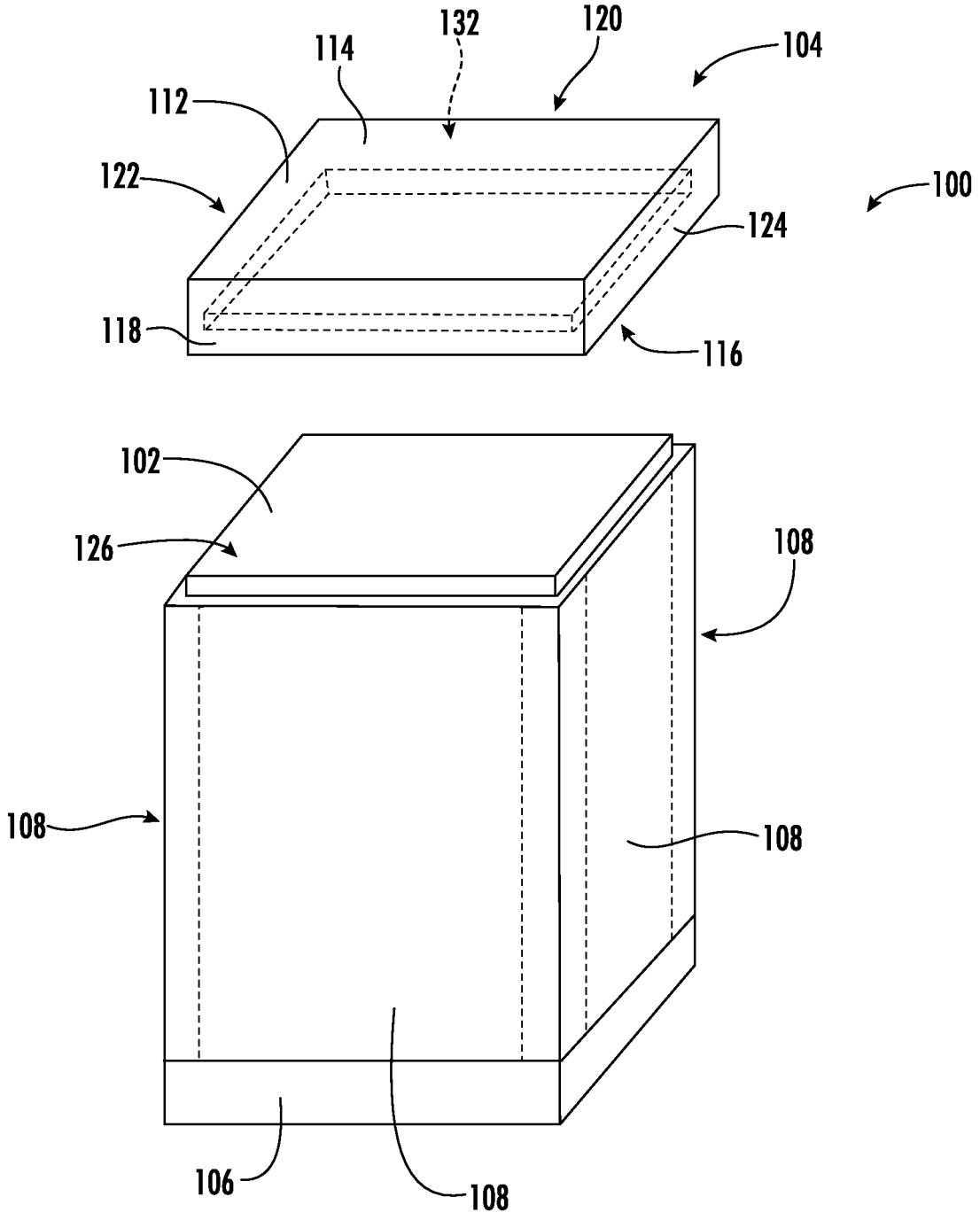
FIG. 2 provides a perspective view of the packaging assembly of FIG. 1 with a top pad removed.
Figure 3:
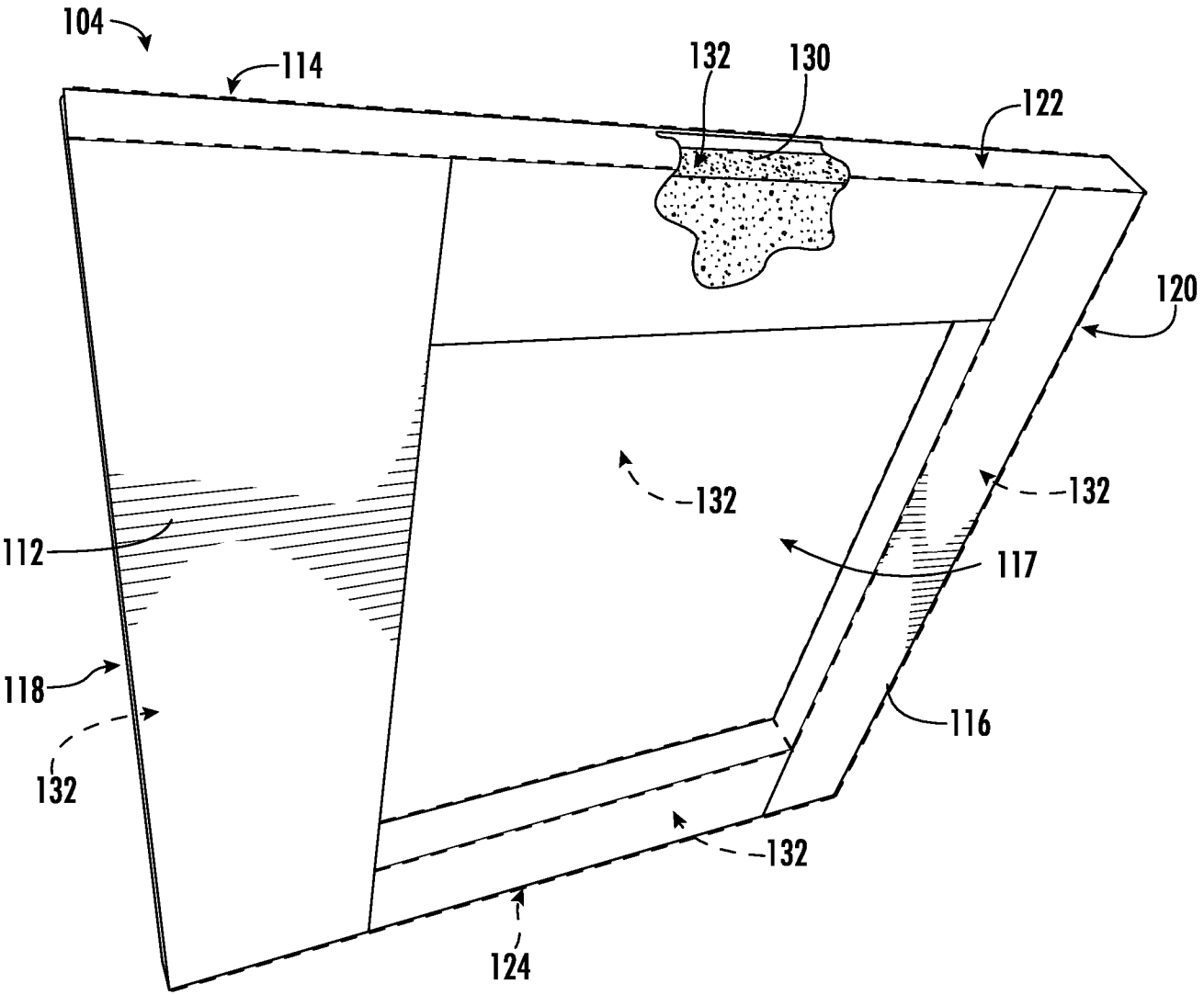
FIG. 3 provides a perspective view of a top pad of a packaging assembly according to one or more exemplary embodiments of the present subject matter.

Referring now to the figures, an exemplary packaging assembly 100 for a domestic appliance 102 is provided. Specifically, FIG. 1 depicts a perspective view of a packaging assembly 100 for the domestic appliance 102, FIG. 2 depicts a perspective view of the exemplary packaging assembly 100 of FIG. 1 with a top pad frame 104 removed, and FIG. 3 depicts an exploded view of the exemplary packaging assembly 100 of FIG. 1. The term "domestic appliance" as used herein may describe appliances typically used or intended for common domestic tasks. According to still other embodiments, these "domestic appliances" may include but are not limited to a refrigerator, a dishwasher, a microwave oven, a cooktop, an oven, a washing machine, a dryer, a water heater, a water filter or purifier, an air conditioner, a space heater, and any other suitable domestic or household appliance.

As best illustrated in FIG. 1, the exemplary packaging assembly 100 generally defines an internal chamber 101 that may be complementary to a predetermined domestic appliance, e.g., a refrigerator, a dishwasher, etc.). The package system may include a corrugated package frame that may include one or more frame components. For instance, in some embodiments, the corrugated package frame of the packing assembly includes a top pad frame 104, a skid or base pad frame 106, a plurality of side wall frames 108, and a plurality of corner post frames 110. Each of the top pad frame 104, the base pad frame 106, the plurality of side wall frames 108, and the plurality of corner post frames 110 may be constructed from one or more pieces of corrugated board 112 (see e.g., FIG. 3).

Alternatively, in some other embodiments, each of the of the top pad frame 104, the base pad frame 106, the plurality of side wall frames 108, and the plurality of corner post frames 110 may be constructed from one or more pieces of corrugated, fiberboard, or cardboard.

Corrugated boards 112 may include one or more liners, for instance, the flat faces of the corrugated board 112. In addition, corrugated boards 112 may include a medium attached to the one or more liners. For example, a single face corrugated board 112 may generally refer to a corrugated board 112 having one liner and a medium attached thereto. As another example, a single wall corrugated board 112 may generally refer to a corrugated board 112 having two liners and a fluted medium attached between the two liners. As should be appreciated, the one or more liners and the medium may both be constructed from a paper-based material, such as cardboard. In this regard, the corrugated package frames may be paper-based corrugated package frames.

The medium may be a fluted layer of the corrugated board 112. For instance, the medium may define a fluted pattern (e.g., a corrugated, a wavy, or a serpentine pattern). Particularly, the medium may give the corrugated board 112 rigidity, strength, and help prevent or mitigate crushing of the corrugated board 112. The medium may be glued to adjacent liners, for instance, with a corn starch-based adhesive. Moreover, each corrugated package frame (e.g., the top pad frame 104, the base pad frame 106, the plurality of side wall frames 108, or the corner post frames 110) may include one or more corrugated boards 112 that together define the shape of the corrugated package frame.

Figure 4:
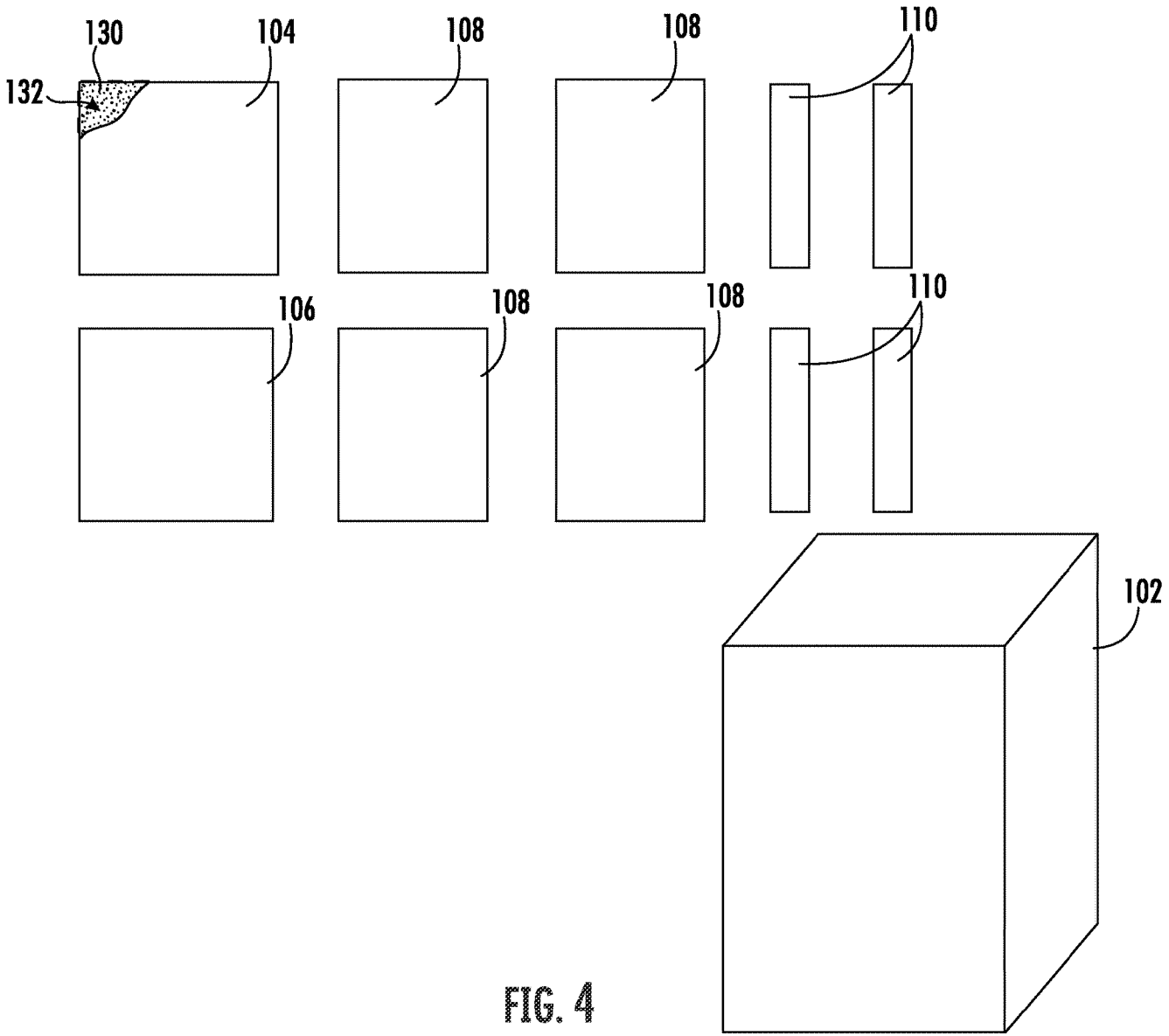
FIG. 4 provides an exploded view of the packaging assembly of FIG. 1.

Referring now to FIGS. 2 through 4, the top pad frame 104 of the packaging assembly 100 is described in more detail. Only the top pad frame 104 may be described herein for the purposes of brevity and clarity only. One of ordinary skill in the art would understand that the subject matter described herein may be applied to any suitable corrugated frame (e.g., the base pad frame 106, the plurality of side wall frames 108, or the corner post frames 110) and is not intended to be limited to only the top pad frame 104.

As is illustrated, the exemplary top pad frame 104 includes a single piece of corrugated board 112. The exemplary corrugated board 112 of the top pad frame 104 may be folded such that the top pad frame 104 forms six main panels. For instance, the top pad frame 104 may include a top panel 114, a bottom panel 116, a front panel 118, a rear panel 120, a first side panel 122, and a second side panel 124. The bottom panel 116 may be formed such that a top portion 126 of the domestic appliance 102 may be placed therewithin. For instance, the bottom panel 116 may be concave portion 117 (e.g., as illustrated best in FIG. 3) such that the top portion 126 of the domestic appliance 102 may fit therewithin.

As should be appreciated, in some other embodiments, each main panel of a corrugated package frame may be an individual corrugated board 112. For example, in some such embodiments, the top pad frame 104 may include six individual corrugated boards 112 that each form a discrete panel (e.g., the top panel 114, the bottom panel 116, the front panel 118, the rear panel 120, a first side panel 122, or the second side panel 124) of the top pad frame 104. In some such embodiments, each corrugated board 112 may include attachment features (e.g., tabs, hooks, slots, etc.) that may be utilized to attach the main panels together in the desired shape.

Each corrugated package frame, (e.g., the top pad frame 104, the base pad frame 106, the plurality of side wall frames 108, or the corner post frames 110) may enclose one or more paper-based package cushion 130 therewithin. As used herein, "enclose" (when used as a verb and including cognates thereof such as "enclosed") may generally refer to corrugated package frame surrounding or closing off the one or more paper-based package cushions 130 on all sides. More particularly, in some embodiments, the panels of the corrugated package frame may fully enclose or encapsulate the one or more paper-based package cushion 130. That is, the panels may surround, encase, or protect the one or more paper-based package cushion 130 in or as if in a capsule. Furthermore, in some embodiments, each panel of the corrugated frame may define an enclosed section 132 that a paper-based package cushion 130 may be enclosed within.

In some other embodiments, the top pad frame 104 may define a plurality of enclosed sections 132 surrounding the concave portion 117. For example, as illustrated in FIG. 3, the top pad frame 104 may include five enclosed sections that surround the concave portion 117. In some such embodiments, a discrete paper-based package cushion 130 may be enclosed within a respective enclosed section 132.

In some embodiments, the paper-based package cushion 130 includes, or is formed as, a molded paper composite. The molded paper composite may include shredded paper material that are formed into a predetermined shape via a wet molding process. The shredded paper material may include any suitable paper material that has been shredded (e.g., torn or cut into strips or fine particles). For example, the shredded paper material may be wastepaper or recycled paper material, such as newspaper, that has been shredded to a desired size or shape.

Generally, the wet molding process may include three steps. The first step being a soaking step, the second step being a molding step, and the third step being a drying step. The soaking step may include soaking the shredded paper material in a liquid solution, for example, a water-based solution, for a predetermined amount of time. The predetermined amount of time that the shredded paper material may soak for may correspond to a consistency of the paper. For instance, as is generally understood, as the shredded paper material is soaked within the liquid solution, the fibers of the paper begin to separate. Generally, the longer the paper is soaking within the liquid solution, the more the fibers separate. Eventually, if the shredded paper material is soaked in the liquid solution for long enough, a pulp like consistency of the shredded paper material may be achieved.

After the shredded paper material has soaked in the liquid solution for the predetermined amount of time, an amount of the soaked shredded paper material may be placed within a mold. The mold may define the predetermined shape of the molded paper composite. For example, the predetermined shape may be any suitable shape that may be enclosed within a corrugated frame (e.g., the top pad frame 104, the base pad frame 106, the plurality of side wall frames 108, or the corner post frames 110) of the packaging assembly 100. For instance, the predetermined shape may correspond directly to the shape of the corrugated frame that it may be enclosed within. That is, the predetermined shape may be approximately the same shape, but slightly smaller than, the respective corrugated frame such that it may be enclosed therewithin. For example, the predetermined shape of the molded paper composite may correspond directly to the shape of the top pad frame 104.

Furthermore, the molding step may include pressing or compacting the soaked shredded paper material within the mold. For example, a presser or compacter (e.g., pneumatic, or hydraulic presser or compacter) may be utilized to press or compact the shredded paper material within the mold. The pressing of the soaked shredded paper material may compact the shredded paper material into the desired shape. Moreover, the force utilized when pressing the soaked shredded paper material or the amount of shredded paper material placed within the mold may correspond to a density of the molded paper composite. For instance, as may generally be understood, the more shredded paper material placed within the mold or the more force that is applied by the presser or compactor during the molding step, the denser the molded paper composite may be. After the molding step, the molded paper composite may be removed from the mold. The molded paper composite may then be dried in any suitable way, for a predetermined amount of time. For example, the molded paper composite may be air dried, dried via a fan, or dried via a low heat conveyer oven, for the predetermined amount of time. In this regard, moisture may be removed from the molded paper composite.

As should be appreciated, the molded paper composite of the paper-based package cushion 130 may be formed into any shape. For instance, as described above, the predetermined shape may correspond to the shape of the corrugated frame that the paper-based package cushion 130 may be enclosed within. However, in some other embodiments, the predetermined shape may be a uniform geometric shape, for example, a sphere or a cube. In such embodiments, the paper-based package cushion 130 may be a paper-based package cushions 130, and more particularly, a plurality of uniform geometric paper-based package cushions 130.

The plurality of uniform geometric paper-based package cushions 130 may be utilized in addition to, or as an alternative to, the paper-based package cushion 130 that may correspond to the shape of the corrugated frame that it may be enclosed within. For example, the plurality of uniform geometric paper-based package cushions may be utilized to fill in voids or gaps that may be present between the corrugated frame and the enclosed paper-based package cushion 130 that may correspond to the shape of the corrugated frame that it may be enclosed within. As another example, the plurality of uniform paper-based package cushions may be enclosed within the corrugated frame to provide cushioning or protection (e.g., to the domestic appliance 102 held within the package assembly.

Embodiments of the present subject matter advantageously provide a packaging assembly including a paper-based package cushioning. The exemplary packaging assembly is advantageously entirely recyclable as it is constructed entirely from paper-based materials. For instance, the packaging assembly may be constructed entirely from paper-based materials unlike conventional packaging assemblies that include synthetic cushioning (e.g., packaging assemblies that may include expanded polystyrene). The exemplary paper-based package cushioning advantageously includes shredded paper material formed into a molded paper composite via a wet molding process. The paper-based packaging cushioning is enclosed within corrugated package frames and used as base frames, wall frames, or corner post frames for domestic or household appliance packaging assemblies. Fully enclosing the paper-based package cushioning within the corrugated frame may advantageously retain the shape of the paper-based package cushioning and provide cushioning during the shipping and handling of the packaging assembly.

This written description uses examples to disclose the invention, including the best mode, and also to enable any person skilled in the art to practice the invention, including making and using any devices or assemblies and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A packaging assembly comprising:

a corrugated package frame comprising a first panel and a second panel, the first panel and the second panel defining an enclosed section; and a paper-based package cushion enclosed within the enclosed section of the corrugated package frame, the paper-based package cushion comprising a molded paper composite, wherein the corrugated package frame further defines an internal chamber for receiving a domestic appliance, and wherein the internal chamber is separate from the enclosed section.

2. The packaging assembly of claim 1, wherein the corrugated package frame further comprises a third panel, a fourth panel, a fifth panel, and a sixth panel, wherein the first panel, the second panel, the third panel, the fourth panel, the fifth panel, and the sixth panel together define the enclosed section to fully enclose the paper-based package cushion within the enclosed section of the corrugated package frame.

3. The packaging assembly of claim 1, wherein the paper-based package cushion is a plurality of paper-based package cushions enclosed within enclosed section of the corrugated package frame.

4. The packaging assembly of claim 1, wherein the corrugated package frame is a paper-based corrugated package frame.

5. The packaging assembly of claim 1, wherein the molded paper composite comprises shredded paper material.

6. The packaging assembly of claim 5, wherein the shredded paper material is wastepaper or recycled paper.

7. The packaging assembly of claim 1, wherein the molded paper composite is a wet molded paper composite formed via a wet molding process.

8. The packaging assembly of claim 1, wherein the corrugated package frame defines an internal chamber complementary to a predetermined domestic appliance.

9. The packaging assembly of claim 8, wherein the corrugated package frame comprises at least one of a top pad frame positioned above the predetermined domestic appliance, a base pad frame positioned below the predetermined domestic appliance, a side wall frame positioned beside at a side of the predetermined domestic appliance, and a corner post frame positioned at an edge of the predetermined domestic appliance.

10. The packaging assembly of claim 1, wherein the first panel and the second panel define, at least in part, an enclosed section, and wherein the paper-based package cushion is enclosed within the enclosed section.

11. A packaging assembly for a domestic appliance comprising:

a corrugated package frame defining an internal chamber for receiving the domestic appliance and an enclosed section; and a paper-based package cushion fully enclosed within the enclosed section of the corrugated package frame, the paper-based package cushion comprising a molded paper composite, wherein the molded paper composite is a wet molded paper composite formed via a wet molding process, and wherein the internal chamber is separate from the enclosed section.

12. The packaging assembly of claim 11, wherein the corrugated package frame further comprises a first panel, a second panel, a third panel, a fourth panel, a fifth panel, and a sixth panel, and wherein the first panel, the second panel, the third panel, the fourth panel, the fifth panel, and the sixth panel together define the enclosed section.

13. The packaging assembly of claim 11, wherein the paper-based package cushion is a plurality of paper-based package cushions enclosed within the corrugated package frame.

14. The packaging assembly of claim 11, wherein the corrugated package frame is a paper-based corrugated package frame.

15. The packaging assembly of claim 11, wherein the molded paper composite comprises shredded paper material.

16. The packaging assembly of claim 15, wherein the shredded paper material is wastepaper or recycled paper.

17. The packaging assembly of claim 11, wherein the corrugated package frame defines an internal chamber complementary to a predetermined domestic appliance.

18. The packaging assembly of claim 17, wherein the corrugated package frame comprises at least one of a top pad frame positioned above the predetermined domestic appliance, a base pad frame positioned below the predetermined domestic appliance, a side wall frame positioned beside at a side of the predetermined domestic appliance, and a corner post frame positioned at an edge of the predetermined domestic appliance.

* * * * *